United States Patent [19]

Gallagher

[11] 4,361,018

[45] Nov. 30, 1982

[54] CONTINUOUS LAUNDERING

[76] Inventor: Paul H. Gallagher, 105 W. Adams St., Chicago, Ill. 60603

[21] Appl. No.: 141,952

[22] Filed: Apr. 21, 1980

[51] Int. Cl.[3] ..... D06F 15/00

[52] U.S. Cl. ..... 68/43; 68/53; 68/158

[58] Field of Search ..... 68/355, 43, 44, 45, 68/53, 158, 175; 134/126, 127, 130, 133, 134; 198/494, 626, 627, 628; 15/89; 26/22, 25, 26

[56] References Cited

U.S. PATENT DOCUMENTS

| | | | |
|---|---|---|---|
| 2,219,582 | 10/1940 | Tarbox | 68/175 X |
| 2,724,493 | 11/1955 | Jones | 198/494 |
| 3,292,397 | 12/1966 | Wooliever | 68/158 X |
| 3,734,270 | 5/1973 | Foody | 198/626 |

FOREIGN PATENT DOCUMENTS

| | | | |
|---|---|---|---|
| 1944304 | 3/1971 | Fed. Rep. of Germany . | |
| 47-36834 | 9/1972 | Japan | 68/158 |
| 760058 | 10/1956 | United Kingdom | 68/44 |

*Primary Examiner*—Philip R. Coe
*Attorney, Agent, or Firm*—Paul H. Gallagher

[57] ABSTRACT

Continuous laundering apparatus having a continuous conveyor carrying the goods to be laundered through the apparatus. Devices additional to, and separate from the conveyor are provided for agitating the goods as they are carried by the conveyor. The conveyor positively carries the goods, including in one form, opposed elements confining the goods therebetween and in another form a single element on which the goods rest. The agitating means includes selectively (a) rollers which are free turning, and turn by engagement therewith by the conveyor and compress the goods between the rollers and a reaction plate; (b) plungers or pushers which are positively driven against the goods, compressing them against the reaction plate; and (c) grippers on opposite sides of the conveyor gripping the conveyor, and thus the goods, between them.

16 Claims, 31 Drawing Figures

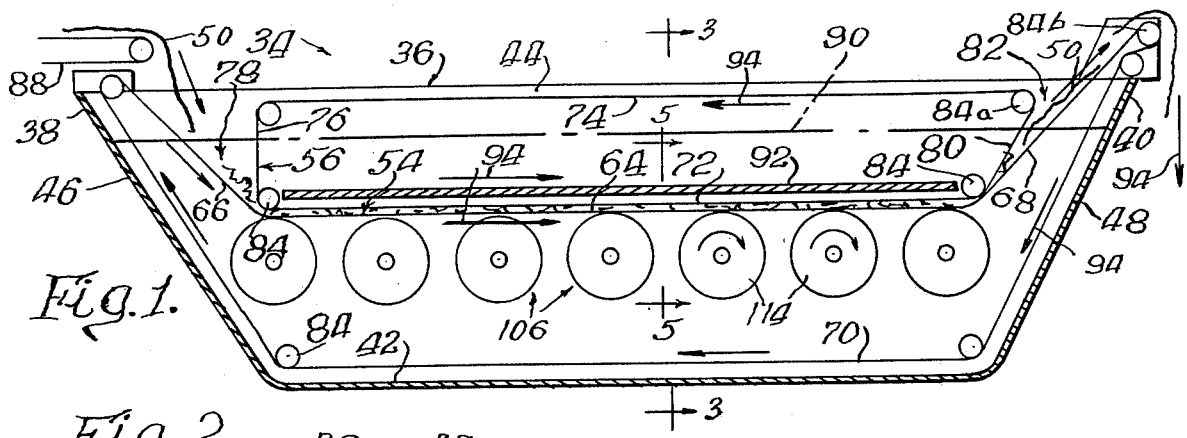
Fig. 1.
Fig. 2.
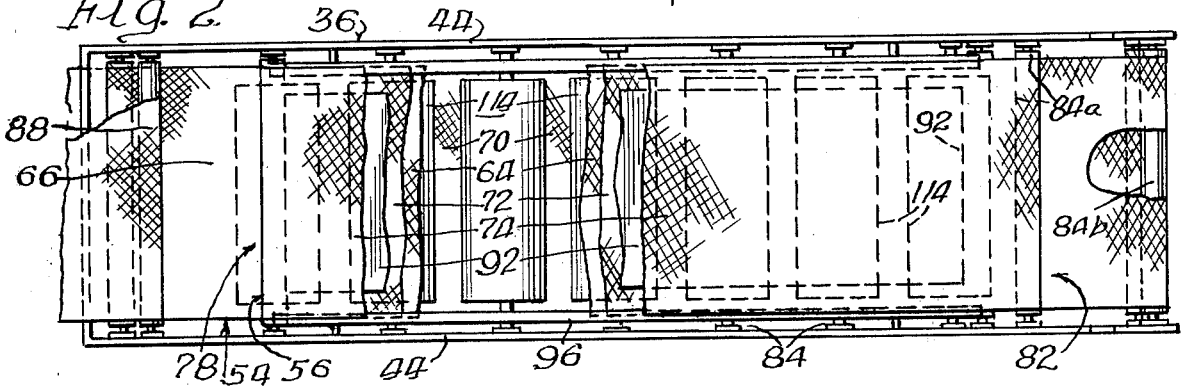
Fig. 3.
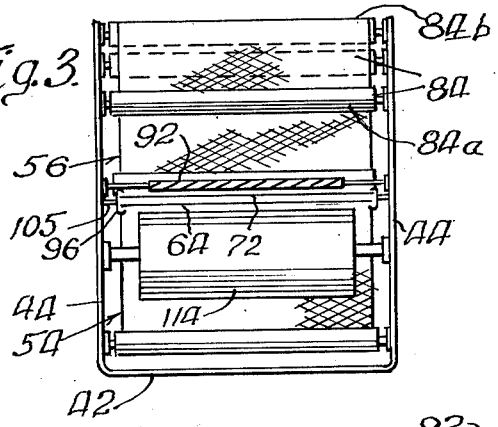
Fig. 4.
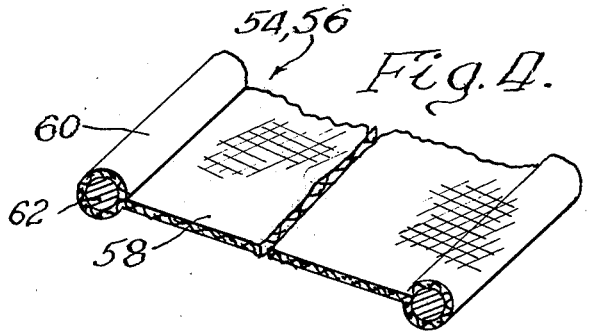
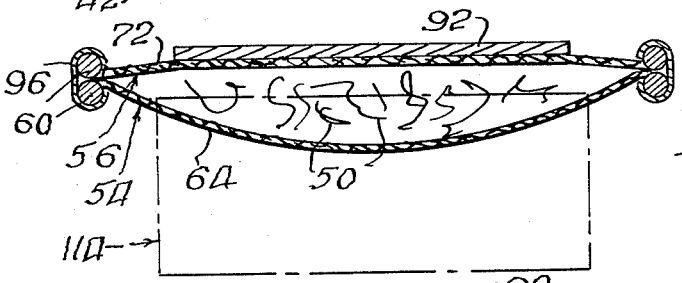
Fig. 5.
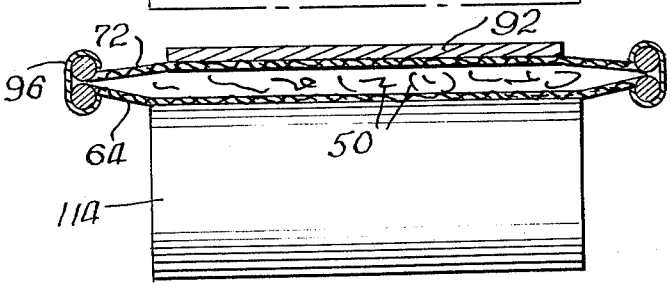
Fig. 6.

Fig. 24.
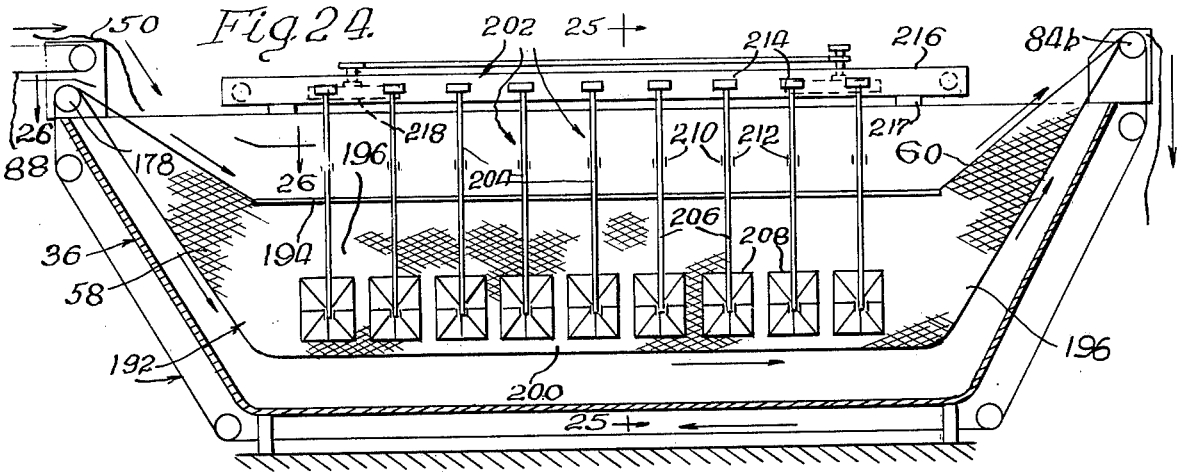
Fig. 25.
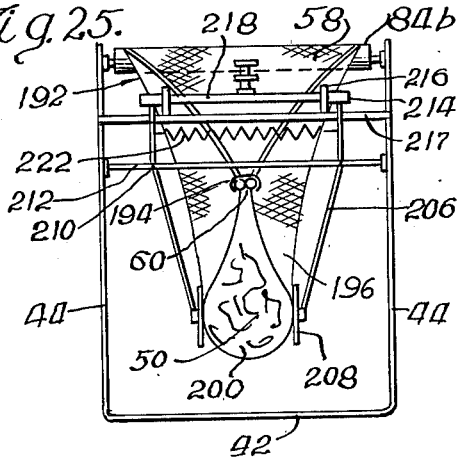
Fig. 26.
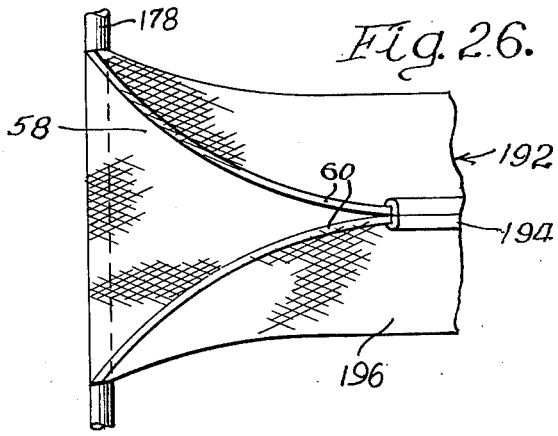
Fig. 27.
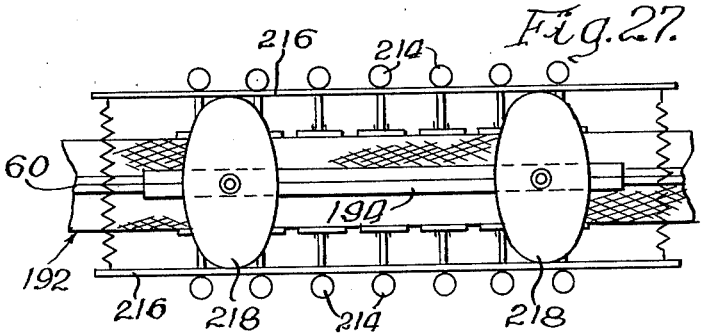
Fig. 28.
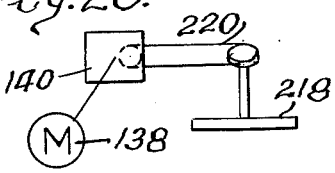
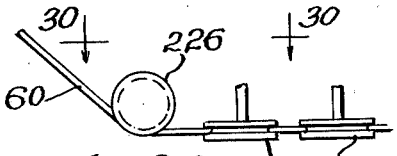
Fig. 29.
Fig. 30.
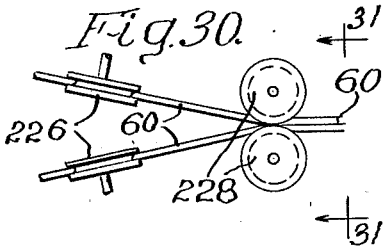
Fig. 31.
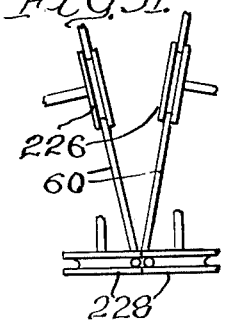

CONTINUOUS LAUNDERING

FIELD OF THE INVENTION

A serious problem that always existed in continuous laundering is that agitation of the goods, which is considered necessary for complete laundering, renders it difficult to move the goods continuously. Continuous operation by its very nature presupposes the movement of the goods in the laundering steps, that is, in order for the laundering operation to be successful or effective, they must be moved along. Implicit is the factor that movement be controlled movement, and this further presupposes that the goods be moved along a predetermined path, because if they are not, they would be moved only randomly, and hence not continuously. Agitation works against such movement of the goods, since agitation by nature is the antithesis of controlled movement. Since agitation works against controlled movement, if the agitation reaches too great intensity, the controlled movement subsides or ceases, and steps must then be taken to re-establish it, and that in effect amounts to batch-type operation. It is often desireable to have the washing water move through the tank, and movement of the goods must include the possibility of moving them against the movement of the water, because if not, the goods would be moved with the water, and by the water, and hence the action of agitation would be nullified. Heretofore, as a practical matter, continuous movement and agitation of the goods were not effectively produced in the same operation.

This invention is directed to overcoming the foregoing difficulties, and broadly, utilizes means for positively conveying the goods and means for agitating them as they are being conveyed.

CROSS REFERENCES

U.S. Pat. No. 4,091,645, issued May 30, 1978, to myself, covering Continuous Laundering Apparatus.

U.S. Pat. No. 4,172,302, issued Oct. 30, 1979, to myself, covering Continuous Laundering Method.

Both of the above patents derived from a common parent application.

These patents cover continuous laundering wherein the goods are positively conveyed through the apparatus, and constantly agitated while they are so conveyed, but in those cases, the conveyor and agitating means are the same instrumentality.

In the present case, a conveyor positively carries the goods, but the agitating means is a separate instrumentality which agitates the goods in the conveyor while they are being conveyed.

OBJECTS OF THE INVENTION

A main object of the invention is to provide novel apparatus and method for continuous laundering, wherein the goods to be laundered are positively carried through the apparatus, and positively agitated as they are being carried, incorporating the following novel features and advantages:

(a) The conveyor and agitating means are separate instrumentalities, producing more effective and efficient operation.

(b) Special kinds of conveyors are utilized for more effectively handling the goods being laundered, including more positively confining the goods.

(c) A great variety of kinds of goods can be handled.

(d) A great variety of kinds of the components, conveyor and agitating means, can be selectively incorporated in the apparatus.

DESCRIPTION OF CERTAIN PREFERRED EMBODIMENTS

In the drawings:

FIG. 1 is a vertical longitudinal sectional view of one form of laundering apparatus embodying the features of the present invention;

FIG. 2 is a top view of the apparatus of FIG. 1;

FIG. 3 is a vertical transverse sectional view taken at line 3—3 of FIG. 1;

FIG. 4 is a fragmentary perspective view of a conveyor belt utilized in the apparatus;

FIG. 5 is a large scale view taken at line 5—5 of FIG. 1;

FIG. 6 is a view similar to FIG. 5 but with the conveyor belt runs im compressed position;

FIG. 24 is a longitudinal vertical sectional view of another form of apparatus of the invention;

FIG. 25 is a view taken at line 25—25 of FIG. 24;

FIG. 26 is a fragmentary view on an enlarged scale taken substantially at line 26—26 of FIG. 24;

FIG. 27 is a top view of the central portion of the apparatus of FIG. 24;

FIG. 28 is a diagrammatic view of a drive for the conveyor means and agitator means of FIGS. 24–27;

FIG. 29 is a simple view, without detail, of a modified form of guide means for the conveyor, oriented in the direction of FIG. 24, and showing elements positioned as if in the upper left hand portion of the latter figure;

FIG. 30 is a view taken at line 30—30 of FIG. 29; and

FIG. 31 is a view taken at line 31—31 of FIG. 30.

Figure 7:
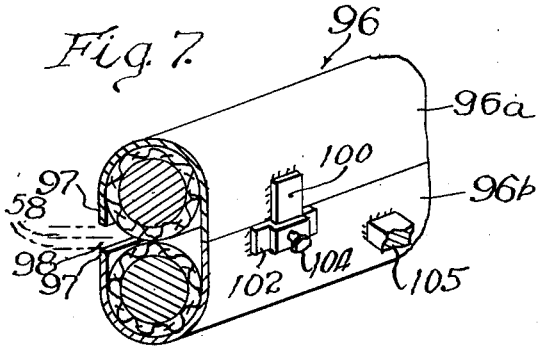
FIG. 7 is a fragmentary perspective view of a means for mounting the conveyor belts and oriented generally in the direction of FIG. 3.

As used herein laundering is a generic term covering different phases, including washing, rinsing, and similar processes.

Referring in detail to the drawings, and particularly to FIGS. 1, 2 and 3 thereof, the apparatus as a whole is indicated at 34 and includes a tank 36, having an inlet end 38 and an outlet end 40. The tank may be of any suitable construction and includes a bottom element or floor 42, side walls 44, an end wall 46 at the inlet end, and an end wall 48 at the outlet end. The tank serves as a framework for mounting other components of the apparatus described hereinbelow.

The items or goods to be laundered may be towels 50, for example.

The apparatus includes conveyor means 52 made up, in the present embodiment, of a lower conveyor 54 and an upper conveyor 56, each of which is an endless belt. FIG. 4 shows a fragment of such a belt and includes a main portion or web 58 which is of open-work, or mesh, form enabling free and virtually unimpeded flow of water therethrough. The belt at the side edges has beads or ribs 60 made up of a central core 62 of relatively incompressible material, such as cord, with the side edges of the web wrapped therearound. These beads extend the full linear length of each belt, and serve as enlargements for guiding the belt as referred to again hereinbelow.

The lower endless belt 54 has a main, horizontal top run 64, extending the main portion of the length of the tank, a downwardly inclined run 66 at the inlet end and an upwardly extending run 68 at the outlet end. The belt 54 has a return run 70 which may be within the tank.

The upper endless belt 56 has a lower main, horizontal run 72 substantially the same length of the main run 64 of the lower belt and closely adjacent thereabove. This belt 56 has a top return run 74, and a vertical run 76 adjacent the inlet end of the tank forming a V space 78 with the run 66 into which the goods are dropped; it also has an end run 80 adjacent the outlet end, inclined upwardly forming a sharp or narrow V shaped space 82 with the run 68, the two runs 80, 68 serving to carry goods from the tank, at the outlet end.

The endless belts are mounted on suitable rollers identified generally at 84, and including one, 84*a*, for driving the upper belt, and another, 84*b*, driving the lower belt. It is not essential that any particular ones of the rollers be utilized for this purpose.

The goods 50 are introduced into the tank by any suitable means such as a conveyor 88 at the inlet end, which drops them into the V shaped space 78. The drive roller 84*b* may be positioned outwardly beyond the outlet end of the tank for facilitating dropping the goods out of the tank.

The dot-dash line 90 indicates a normal level of water utilized in the laundering operation, this level being above the runs 64, 72. All of the agitating action thus takes place immersed in the water as will be understood, and the goods are conveyed in the water throughout nearly the full length of the tank.

A horizontal reaction plate 92 is mounted immediately above the runs 64, 72, which serves as a reaction member for the agitating means as referred to hereinbelow.

The conveyor belts are driven in the directions indicated by the arrows 94, and in accordance therewith the two runs 64, 72 of the two conveyor belts travel from the inlet end to the outlet end. These two runs together with the reaction plate 92 extend through and form an operating range in the laundering steps. The goods upon being dropped into the V space 78 are carried into the space between the runs 64, 72, and thus carried thereby in the direction noted. These belt runs extend transversely a substantial portion of the width of the tank (FIG. 3). One means for positioning and guiding the runs 64, 72 may take the form of channels 96 which receives the beads 60 of the belts and confine them therein, the terminal side edges 97 (FIG. 7) of the channels defining openings 98 accommodating the thickness of the two web elements, but holding the beads therein. These channels include a pair of sections, 96*a*, 96*b* which can be separated for fitting the beads of the web therein. These sections include for example a cleat 100 on one section and a loop 102 on the other, for receiving the cleat, and set screws 104 securing them together. A mounting bar is shown at 105 by which the channels are mounted on the side walls of the tank.

The side edges of the two runs 64, 72 are held together so that the two runs form in effect a run that is continuous circumferentially in transverse directions, in the form of a tube, confining the goods therein. The channels 96 extend only the length of the runs 64, 72, and longitudinally beyond the channels the runs separate at the spaces 78, 82.

Figure 8:
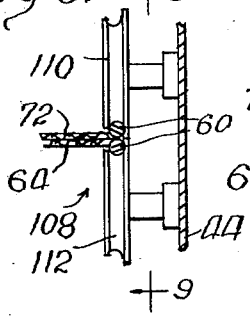
FIG. 8 is a view of a modified form of means for supporting the conveyor belts and oriented longitudinally, corresponding generally with FIG. 7.
Figure 9:
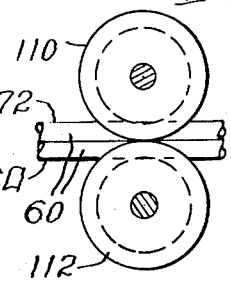
FIG. 9 is a view taken at line 9—9 of FIG. 8.

FIGS. 8 and 9 show an alternative construction for securing the side edges of the belt runs 64,72. In these figures, the supporting means is indicated in its entirety at 108, and includes pulleys 110, 112 on axes transverse to the tank. These rollers, one above the other, have grooves receiving the beads 60 of the mesh. These pulleys are free-rotating, following the longitudinal travel of the belts, but confining the beads.

Figure 10:
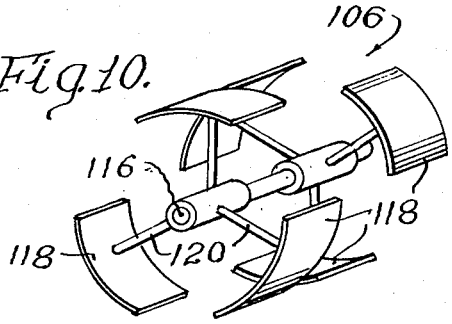
FIG. 10 is a fragmentary perspective view of one form of agitator means in the form of a roller.

One form of agitating means is indicated as a whole at 106 in FIG. 10. In the laundering operation, the agitating means agitates the goods 50 between the runs 64,72, and in doing so works upwardly against those runs, and consequently against the reaction plate 92, compressing and squeezing the goods therebetween in an effective agitating action.

Figure 13:
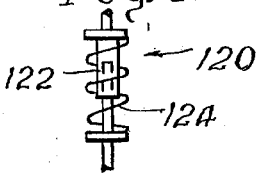
FIG. 13 is a detail view of a construction for enabling telescoping action of the arms of an agitator means.

The agitating means 106 includes, in this form, a plurality of free-rotating rollers 114, on transverse axes, extending nearly across the belts. Each roller 114 includes a shaft 116 and a plurality of peripheral elements 118 mounted on radial arms 120. The peripheral elements 118 are preferably spaced apart circumferentially, and include a plurality of groups spaced axially, with the elements of one group staggered circumferentially relative to those of the axially adjacent group. These arms 120 are preferably of telescopic construction, utilizing any convenient form such as shown in FIG. 13 which shows an arm 120 having a telescopic portion 122 carrying the peripheral element 118, the two elements being biased apart, longitudinally, by a compression spring 124. These radial arms 120 are of such length that the peripheral elements 118 are radially engaged by the lower run 64, and that run may even rest on the rollers. As the run 64 progresses, it turns the roller by friction, and the radial arms 118 in the roller are of such length that as the peripheral element engage the lower run they move upwardly to flex the conveyor and compress or squeeze the goods against the reaction plate 92. These peripheral elements move into and out of engagement with the belt runs in repeated fashion, and each peripheral element remains in engagement only during a very short interval of time, and throughout substantially the entire period of engagement, it is moving toward and from the belt so as to provide the agitating effect.

FIGS. 5 and 6 indicate the agitating action. In these figures the goods 50 are shown between the runs 64, 72, and there is a space between the agitating rollers 114 where the lower run 64 sags, in spaced relation below the upper run 72. As the runs progress, to the next agitating roller 114, the lower run is pushed upwardly, as explained above, this condition being shown in FIG. 6. These two FIGS., 5 and 6, show the agitating roller 114 only diagrammatically, for simplicity. In FIG. 6, with the lower run 64 raised, the goods are relatively compressed, it being understood that the extent of compression would depend on many factors, including the thickness of the goods, and the representation of FIG. 6 includes that condition where the goods are compacted tightly.

The incorporation of a relatively large number of rollers 114 provides the agitating effect at many localized areas in the goods, and the number of rollers, and the aggregate number of peripheral elements 118 on all of the rollers together, provide agitating effect in a great number of localized, separated and spaced, areas of the goods. The positioning of the peripheral elements 118 may be such as to provide the desired agitating effect in almost any desired locations, and number of areas. The telescoping construction of the radial arms 120, as shown in FIG. 13, accommodates variations in thickness of the goods between the runs 64, 72 whereby it is not necessary to provide even-thickness distribution of the goods. The tank may be of any desired length within practical limits, with the agitating means distributed nearly the entire length of the tank.

Figure 11:
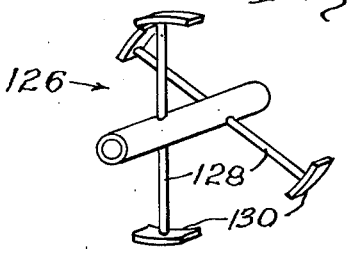
FIG. 11 is a view similar to FIG. 10 of a modified form of agitator means.

FIG. 11 shows a modified form of agitating roller, indicated at 126, which is generally similar to that of FIG. 10, but includes radial arms 128 with small peripheral elements 130 which may be of much smaller total area than the corresponding elements 118, and these may be positioned at any desired spacing, and may be as numerous as desired.

Figure 12:
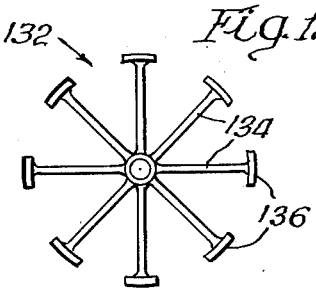
FIG. 12 is an end or axial view of another form of agitator means.

FIG. 12 is an axial view of another form of agitating roller identified as 132 having radial arms 134 with peripheral elements 136, of much smaller size, and greater number. The construction of FIG. 12 is slightly modified from that of FIG. 11, the three FIGS., 10, 11 and 12, showing a variety of rollers that may be adapted to different kinds of goods.

The conveyors may be driven by any suitable means, as will be understood. It is practical to drive only the lower conveyor belt 54 for example with the upper conveyor belt 56 free-running or floating. A suitable drive means is shown diagrammatically in FIG. 14 which includes a driving motor 138 operating through a drive transmission unit 140, and acting through a belt 142, driving the roller **84*b* of the lower belt. In this case, the upper belt 54 would be driven by the friction engagement with the lower belt 56**. As noted above the agitating means may be free-running, requiring no outside drive, but driven by the conveyor runs.

Figure 14:
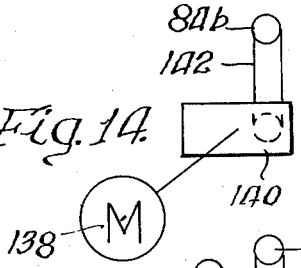
FIG. 14 is a diagrammatic illustration of the drive for the conveyor means.
Figure 15:
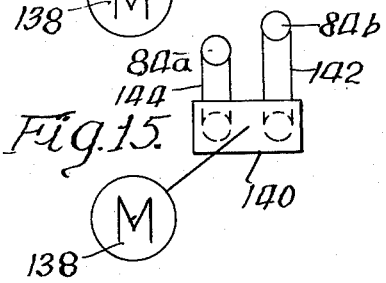
FIG. 15 is a view similar to FIG. 14 of a slightly modified form of drive means.

If it is desired to provide independent drive for each of the conveyor belts 54, 56, an arrangement shown in FIG. 15 may be utilized, this arrangement including the elements of FIG. 14, and an additional drive, operating through a belt 144 driving the roller **84*a*, identified above, which would then drive the upper belt 56. The drive transmission means 140** would of course operate to drive the two belts at the same linear speed.

Figure 16:
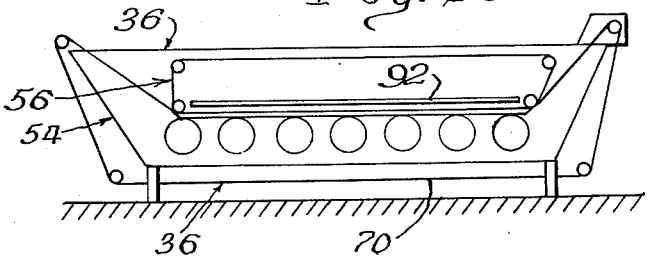
FIG. 16 is a semi-diagrammatic view, orented according to FIG. 1, of a modified form of apparatus.

FIG. 16 shows a slightly modified form of apparatus relative to the foregoing, in that the return run 70 of the lower belt 54 is disposed under the tank 36, while in the foregoing it returned within the tank. In the present instance the agitating means can be mounted directly on the floor of the tank while in the previous form they are mounted in the side walls because of the return run being in the tank.

Figure 17:
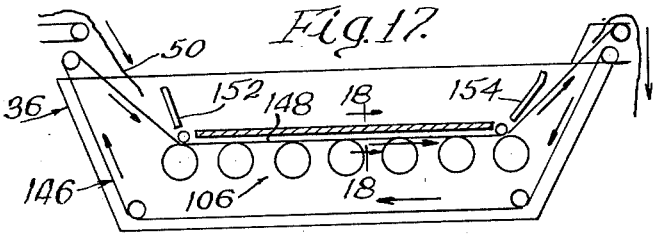
FIG. 17 is a semi-diagrammatic view of another modified form of apparatus, oriented according to FIGS. 1 and 16.
Figure 18:
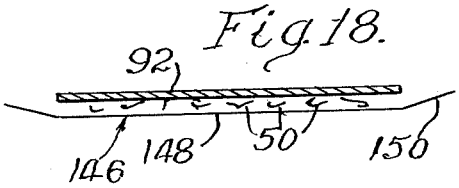
FIG. 18 is a detail view taken at line 18—18 of FIG. 17.

FIGS. 17 and 18 show a further modified form of apparatus, utilizing only a single endless belt 146. In this case the main top run 148 corresponding with the run 64 is positioned directly under the reaction plate 92, and with that plate confines the goods 50 as represented in FIG. 18, the reaction plate becoming in effect a part of the conveyor means. In this form the side edge portions of the belt run are inclined upwardly slightly as indicated at 150, aiding in retaining goods in place between the belt and the reaction plate.

In this construction, FIGS. 17 and 18, guide plates 152, 154 are provided, the former guiding the goods into the space between the belt run and the reaction plate, and the latter assisting in guiding the goods in leaving at the outlet end.

Figure 19:
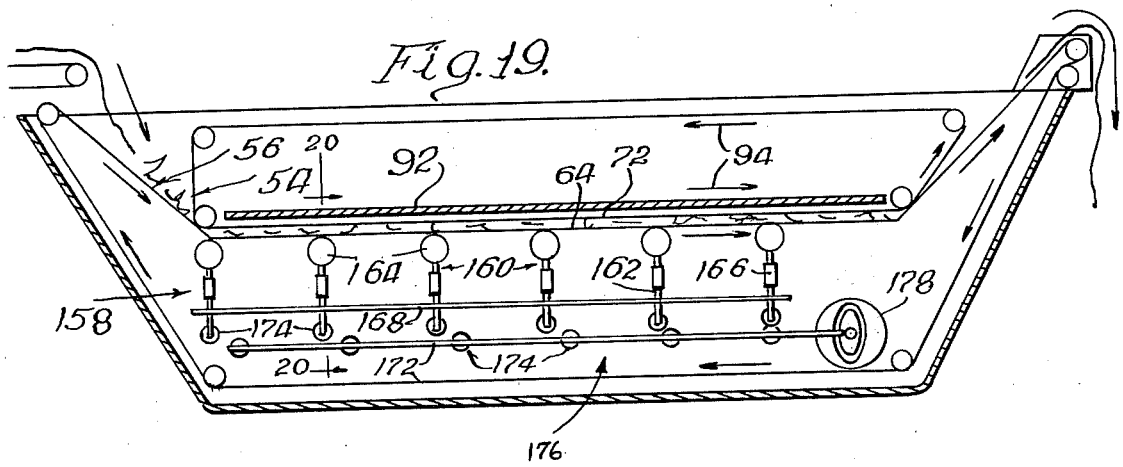
FIG. 19 is a longitudinal vertical sectional view of an apparatus embodying a modified form of agitating means.
Figure 20:
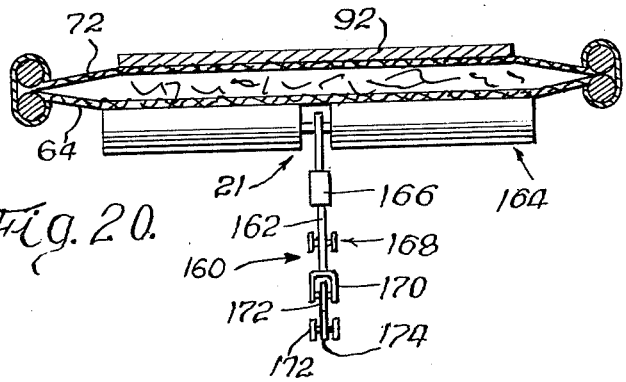
FIG. 20 is a view taken at line 20—20 of FIG. 19.
Figure 21:
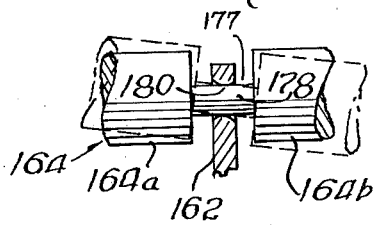
FIG. 21 is an enlarged detail fragmentary view of the element at point 21 of FIG. 20, showing the mounting of the roller means for rocking movement.

FIGS. 19–21 show a modified form of agitating means. This construction includes the two belts 54, 56 and the reaction plate 92 of the first form, but instead of the agitating means 106 utilized above, a modified form 158 is utilized. The present form includes a plurality of plungers or pushers 160, each of which includes a vertical shank 162 having a roller 164, forming an agitating element, at the upper end thereof, and including a telescoping segment 166 similar to that shown in FIG. 13. The shanks 162 are mounted in suitable mounting means 168 extending longitudinally of the tank and permitting relative vertical movement of the shanks for the agitating action. The shanks at their lower end have forks 170 in which are cam follower rollers 172. The means for actuating the plungers includes a plurality of camming elements 174 preferably in the form of rollers, and mounted on a rack 176 extending longitudinally of the tank, the rack being reciprocated longitudinally by a main cam 178. Upon actuation of the main cam and consequent reciprocation of the rack, the camming elements 172 engage the cam follower rollers 172 and raise the plungers to carry the rollers 164 into agitating engagement with the runs of the conveyors in a manner similar to that described above. The rollers 164 are illustrated diagrammatically, and they may take any of various forms, including that illustrated in FIG. 10–12. FIG. 19 shows the camming elements 174 at spacings different from the cam follower elements 172, with the result that the plungers are agitated seriatim, so as to distribute the agitating action better throughout the working area.

Preferably the rollers 164 are mounted for limited rocking movement about an axis longitudinally of the tank. This is represented in FIG. 21, where the roller 164 includes two axially spaced sections **164*a* and 164*b* on a central shaft 177. The shaft extends through an aperture 180 in the shank 162, this aperture being of double taper shape to enable the roller to rock as indicated, this rocking action, together with the yielding telescoping accommodations of the segment 166**, accommodating different thicknesses of goods at various locations.

Figure 22:
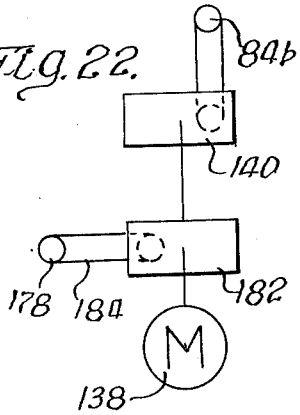
FIG. 22 is a diagrammatic view of drive for the conveyor means and agitating means of FIG. 19.

The apparatus also includes means for driving the conveyor means and the agitating means at selectively different rates of speed. This feature of the invention is similar to a corresponding feature in my prior patents referred to above, where the rate of conveying the goods and the rate of agitation can be independently controlled. In the present case such an arrangement is represented by FIG. 22 where the motor 138 drives the drive transmission unit 140 identified above and the roller 84*b* of the conveyor means. The present arrangement also includes a second drive transmitting unit 182 which, acting through a belt 184 drives the main cam 178 (FIG. 19). These drive transmitting units 140, 182 are independently adjustable for driving the end members, 84*b*, 178, at the respectively different speeds.

Figure 23:
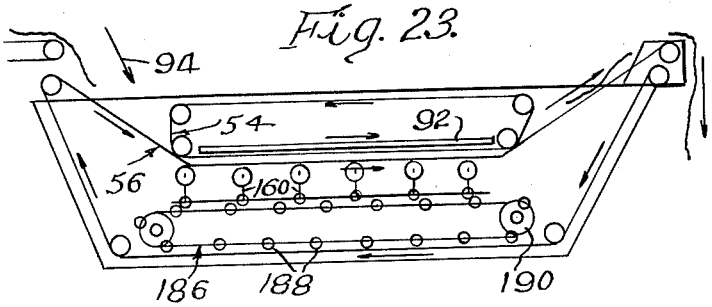
FIG. 23 is a view similar to FIG. 19, but on a smaller scale, showing apparatus with another form of agitating means.

FIG. 23 shows an apparatus similar to FIG. 19, but with a different form of agitating means. Instead of the main cam 178 and rack 176 which holds the camming members 174, of FIG. 19, the present arrangement includes an endless belt or chain 186 in which are supported camming elements 188 corresponding to the camming elements 176. The chain or belt 186 is driven by a wheel or sprocket 190, and it will be noted that the camming elements 188 are spaced linearly along the chain at a spacing different from that of the plungers 160. The plungers 160, and the remainder of the apparatus may be the same as in FIG. 19.

Attention is next directed to FIGS. 24–28, which shows another modified form of apparatus. In this form, agitating means is utilized which is similar to the instrumentality in my prior patents referred to where it is utilized for both conveying and agitating. In the present instance the tank 36 previously described is utilized, but instead of the endless conveyors of the kind described above, a single conveyor 192 is utilized. This conveyor is an endless belt type and is similar to the conveyor belts described above in that it is of open-work mesh type material 58 with beads 60 at the side edges. The web is relatively wide and is doubled, with the beads 60 mounted in a channel 194 (FIG. 25) similar to the channel 96. The belt thus doubled, includes a depending central bag shape portion 196 in which the goods 50 are confined. The belt is trained over suitable rollers, such as the roller 84*b* identified above and another roller 98 at the inlet end. The belt is opened in flat condition in passing over these rollers (FIG. 26) and the side edges then brought in together where they are confined by the channel 194, this channel extending longitudinally of the tank the greater part of the length thereof. The belt thus, in its central portion, includes a main or operating run 200 where the goods are confined and where the agitation takes place. The goods are introduced at the inlet end by the conveyor 88, and they are delivered out of the tank over the roller 84*b* as referred to above. The endless belt, outside of the tank, may have a return run in any convenient location, such as under the tank, over the tank, etc.

In the present instance, FIGS. 24–28, the agitating means is indicated in its entirety at 202. The agitating means includes a plurality of grippers 204 each including an upright arm 206 and the gripper plate 208. The gripper members are arranged in pairs with those of a pair on opposite sides of the conveyor (FIG. 25). The arms 206 are pivoted at 210 in a suitable supporting means 212 and the gripper plates 208 are pivoted in the lower ends of the arms. The arms 206 are pivoted on axes extending longitudinally of the tank and they are enabled, in their mounting, for limited rocking movement about transverse axes. The arms have cam rollers 214 at the top, which engage bars 216 extending longitudinally and spaced apart transversely. The bars 216 are supported on transverse structural pieces 217 and are moveable transversely and spread apart by a pair of longitudinally spaced cams 218 (FIGS. 25, 27) which are driven by suitable means, such as that represented in FIG. 28 which includes the driving motor 138 and drive transmitting unit 140. The latter acting through a belt 220 drives the cams 218. Upon rotation of the cams, the bars are spread, and later retracted by a tension spring 222 connected between the upper ends of the arms 206. Upon swinging of the upper end of the arms 206 outwardly, the lower ends are swung inwardly, whereby the gripper plates 208 grip the central portion of the conveyor belt therebetween, and thus the goods 50 therein. This gripping action produces the desired agitation of the goods. The gripper plates 208 are preferably of open-work construction, readily permitting the flow of washing water therethrough as described in my prior patents referred to.

Upon the gripper plates 208 gripping the conveyor, and because the conveyor runs continuously, the gripper plates and the lower ends of the arms 206 must necessarily swing with the movement of the conveyor. This movement is accommodated by the limited movement, referred to above, of the arms about transverse axis. In this movement also, the follower rollers 214 roll along the bars 216.

The cams 218 may be driven in synchronism so that the bars 216 at both ends spread simultaneously, and in this case all of the gripper plates 208 are moved inwardly in agitating action simultaneously. It is not necessary however that these cams act in synchronism, but may be staggered in their action.

FIGS. 29–31 show alternate means of supporting the endless belt 192 in the apparatus of FIGS. 24–27. This supporting means utilizes grooved pulleys instead of the channel 194 described above. In these figures the beads 60 on the opposite side edges of the belt represent the belt. These figures also show pairs of grooved pulleys 226, 228. At the left of FIG. 29, the inclined beads 60 are disposed at the inlet end of the tank and they ride under pulleys 226, on axes which are generally transverse to the tank, but are not coaxial, as shown in FIG. 30. The beads 60 in the folding action of the belt, converge to form the V shape of FIG. 30, the pulleys 226 being positioned to accommodate that disposition of the beads. The beads then pass between the pulleys 228 which are disposed on vertical axes and positioned close together, confining the beads of the conveyor belt therebetween and holding the main run 200 thereby. The pair of rollers 228 of FIG. 29 represents a succession of such rollers of any desired number and extent, to support the main run of the belt. The rollers 228 therefore serve the same purpose as the channel 194. In the present instance, as in the modification referred to above, in which both the conveyor means and agitating means are positively driven, these two components may be driven at selectively chosen speeds according to various factors involved, such as the toughness or fragility of the goods, the character of the soil to be removed, whether it is a washing or a rinsing operation, etc. Thus this feature of the invention provides the advantages of a similar feature disclosed and claimed in my prior patents referred to. The apparatus is adapted to different phases of laundering, such as washing, rinsing, etc., as indicated above, and in this aspect of the operation, a plurality of units of such apparatus may be placed in serial arrangement, the goods passing from one unit to the next, and the rate of progression or conveying of the goods through the series of units, may be uniform, while the degree of agitation in the different units may be varied, according to the factors involved as referred to.

The goods are confined in their conveyance through the apparatus and thus the operation is continuous in the strictest sense of the word. The agitation may be provided to any extent, without in any way interfering with such a conveyance of the goods. The goods are not displaced longitudinally of the belt means, at least to any great extent, or to an extent that would impede or interfere with the conveyance of the goods.

The agitating action, being spaced both along the length of the line of conveyance, and in time periods, produces an exceptionally good agitating action. The agitation takes place both in compressing the goods, and in withdrawing the agitating elements away from the goods, this action being accomplished at least partially by the general turbulence of the water which constantly tends to move the goods around, and consequently the goods after being compressed by one agitating element, are moved out of a compressed condition and again are moved into a compressed condition by the next or following agitating element.

Because of the confinement of the goods by the conveyor means, and the controlled movement of the goods along the predetermined path, they are conveyed in such path independently of the action of the water, there being no possibility of goods being displaced out of the conveyor. Another direct and immediate benefit of this feature is that the water may flow in direction opposite to the movement of the goods with a known beneficial effect.

I claim:

1. Apparatus for laundering goods, comprising, a tank for holding a quantity of laundering water to establish a normal water level within the tank, and the tank having an inlet end and an outlet end, conveyor means including a pair of endless belts made up of mesh enabling water to flush therethrough substantially unimpeded, the belts having respective runs adjacent each other, guiding means joining the side edges of said respective runs together and forming a tube thereof continuous circumferentially therearound, the guiding means being operative for positioning those respective runs in horizontal position, below the water level, and the tube extending in an operating range nearly the length of the tank, the belts forming V-shape inlet and outlet sections respectively adjacent the inlet and outlet ends of the tank, and the conveyor means being operative for receiving goods, in loose and non-continuous form, in the V-shape inlet section, carrying them through the tube, and carrying them through the V-shape outlet section, up out of the water and out of the tank, and means for agitating the goods including movable members spaced along said tube and yieldingly engaging at least one of the said runs and thereby agitating the goods between the runs, and reaction means on the side of the runs opposite the movable members and thereby positioned for receiving the thrust from the movable members.

2. Laundering apparatus according to claim 1 wherein, the apparatus includes means for mounting the endless belts, said mounting means including enlarged beads on the side edges of the belts, and also including said guiding means, the guiding means including grooved pulleys in said operating range at the side edges of the belts receiving the beads of the two runs, and confining them.

3. Laundering apparatus according to claim 1 wherein, the apparatus includes separate means, independently controllable, for driving the conveyor means and the agitating means at different rates of speed.

4. Laundering apparatus according to claim 1 wherein, the apparatus includes means for driving the agitating means independently of the conveyor means, the agitating means includes plungers movable, in direction longitudinally of the plungers, toward and from the conveyor means, in the direction of the thickness of the conveyor means, in said operating range, and the plungers are yieldable in longitudinally contracting direction to compensate for uneven thickness of the conveyor means due to uneven amounts of goods therein.

5. Laundering apparatus according to claim 4 wherein, the plungers of the agitating means include cam followers, the apparatus includes camming means engageable with the cam followers for actuating the plungers, and means for driving the camming means.

6. Laundering apparatus according to claim 5 wherein, the camming means includes a reciprocatory member carrying cam elements for engaging the cam followers individually, and the means for driving the camming means includes a main cam for reciprocating the reciprocatory member.

7. Laundering apparatus according to claim 5 wherein, the camming means includes an endless cam belt carrying cam elements for engaging the cam followers individually, and the means for driving the camming means includes a wheel for driving the endless cam belt.

8. Laundering apparatus according to claim 4 wherein, the plungers include rollers extending transversely of the conveyor means and constituting the immediate elements of the plungers that engage the conveyor means, and the plungers include means mounting the rollers for rocking movement about an axis longitudinally of the conveyor.

9. Laundering apparatus according to claim 1 wherein, the agitating means is located bodily adjacent the path of movement of the conveyor means, and the agitating means and the conveyor means have operably interacting elements whereby the conveyor means in moving engages the agitating means and thereby activates it and the agitating means thereby agitates the conveyor means and goods.

10. Laundering apparatus according to claim 9 and including, variable-speed means for driving the conveyor means, the conveyor means, in engaging the agitating means, is thereby operative for activating the agitating means at a speed corresponding to the speed of the conveyor means.

11. Laundering apparatus according to claim 9 wherein, the agitating means includes rollers on fixed axes, the rollers have peripheral surfaces that are interrupted forming circumferential spaced elements, and those spaced elements constitute a portion of said interacting elements and are engaged by the conveyor means, whereby the conveyor means rotates the rollers and said peripherally spaced elements engage the conveyor means and agitate it.

12. Laundering apparatus according to claim 11 wherein, the peripheral surfaces are interrupted to form the circumferentially and axially spaced elements, and those elements are staggered proceeding in axial direction.

13. Laundering apparatus according to claim 12 wherein, the peripheral portions of the rollers are so positioned that, considered totally, they engage all portions of the conveyor means effective transversely and substantially longitudinally, throughout the movement of the conveyor means in the tank.

14. Laundering apparatus according to claim 9 wherein, the agitating means includes free running rollers mounted concentrically on their central longitudinal axes.

15. Laundering apparatus according to claim 1 wherein, the reaction means is in the form of a plate of substantial area and extends over said runs substantially throughout the area of the runs engaged by the movable members.

16. Laundering apparatus according to claim 1 wherein, the apparatus includes means for mounting the endless belts, the mounting means including enlarged beads on the side edges of the belts and also including said guiding means, the guiding means including fixed channels in said operating range, at the side edges of the belt receiving the beads of the two runs at corresponding sides of the belt, and confining them, and the mounting means thereby including the means for making the runs effectively circumferentially continuous.

* * * * *